United States Patent [19]

Christen

[11] Patent Number: 4,785,967

[45] Date of Patent: Nov. 22, 1988

[54] LINER FOR A MIXER CONTAINER

[75] Inventor: Werner Christen, Mannheim, Fed. Rep. of Germany

[73] Assignee: Draiswerke GmbH, Mannheim, Fed. Rep. of Germany

[21] Appl. No.: 825,873

[22] Filed: Feb. 4, 1986

[30] Foreign Application Priority Data

Feb. 6, 1985 [DE] Fed. Rep. of Germany ..... 3503896

[51] Int. Cl.[4] ..... B65D 90/04

[52] U.S. Cl. ..... 220/400; 220/434; 220/435

[58] Field of Search ..... 206/527; 220/400, 434, 220/435, 437, 320

[56] References Cited

U.S. PATENT DOCUMENTS

| | | | |
|---|---|---|---|
| 304,092 | 8/1884 | Francke | 220/345 |
| 1,992,470 | 2/1935 | Carlstrom | 220/400 |
| 2,406,708 | 8/1946 | Pepersack | 220/400 |
| 2,460,052 | 1/1949 | Werner | 220/435 |
| 3,456,835 | 7/1969 | Marcmann | 220/437 |
| 4,156,492 | 5/1979 | Cavanna et al. | 220/435 |
| 4,188,130 | 2/1980 | Engels . | |

FOREIGN PATENT DOCUMENTS

| | | | |
|---|---|---|---|
| 0077838 | 9/1981 | European Pat. Off. . | |
| 1653181 | 12/1971 | Fed. Rep. of Germany . | |
| 2653683 | 6/1978 | Fed. Rep. of Germany . | |
| 113860 | 9/1981 | Japan | 220/435 |

*Primary Examiner*—David T. Fidel

*Attorney, Agent, or Firm*—Browdy and Neimark

[57] ABSTRACT

A liner for a cylindrical container (1) of a mixer for mixing materials that tend to adhere has at least one plate (18) of antiadhesive plastic, which is interchangeably located on the inner wall (9) of the container (1). In order to devise a largely unsecuted and thus easily mountable linear, the at least one plate (18) is elastically pressed radially outward, in the vicinity of the ends of the container (1), against the inner wall (9) of the container (1) by at least one tension ring (21, 22). The tension rings (21, 22) comprise smooth, plate-like plastic preventing the adhesion of materials.

5 Claims, 3 Drawing Sheets

FIG. 1
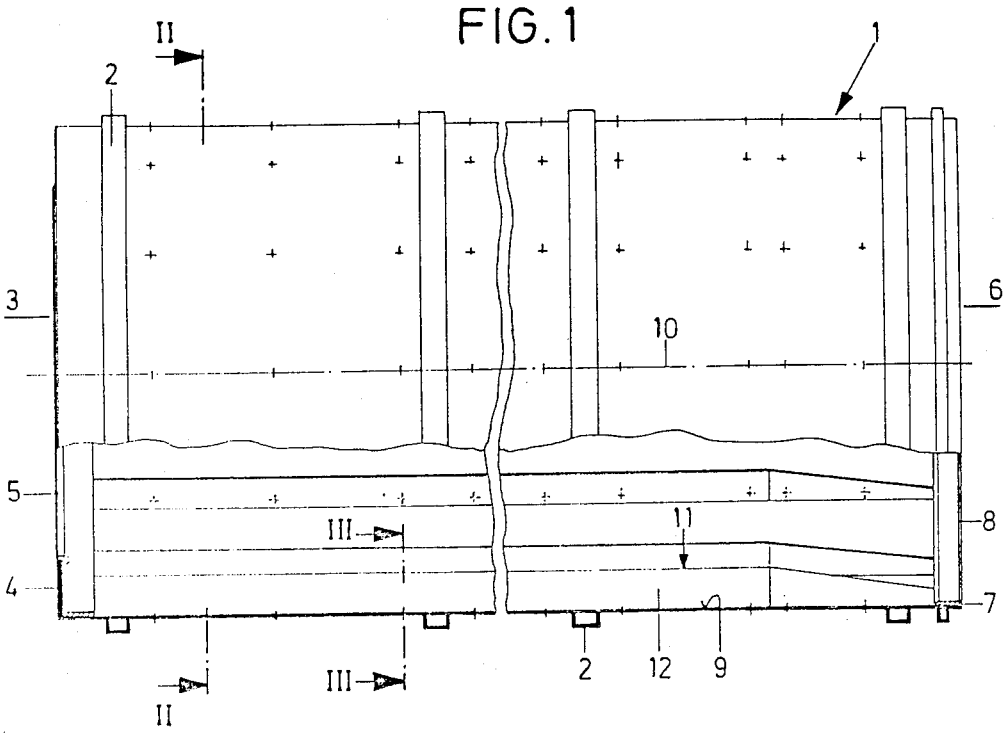
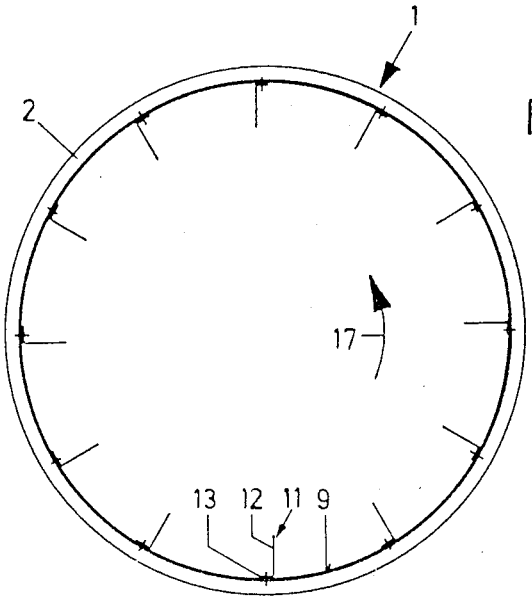
FIG. 2

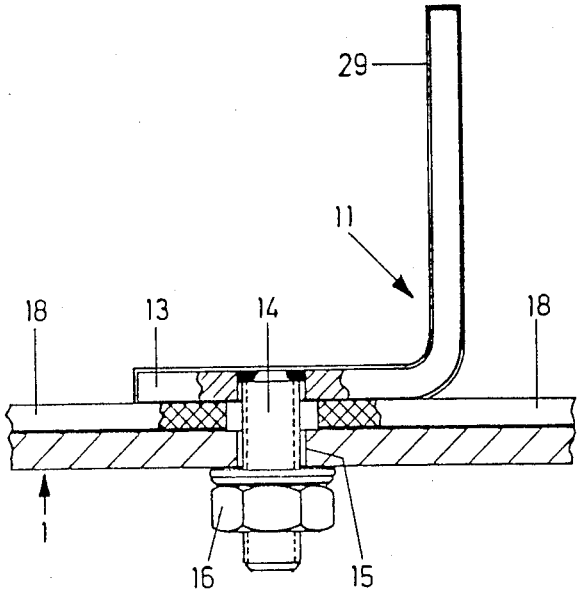
FIG. 3
FIG. 4
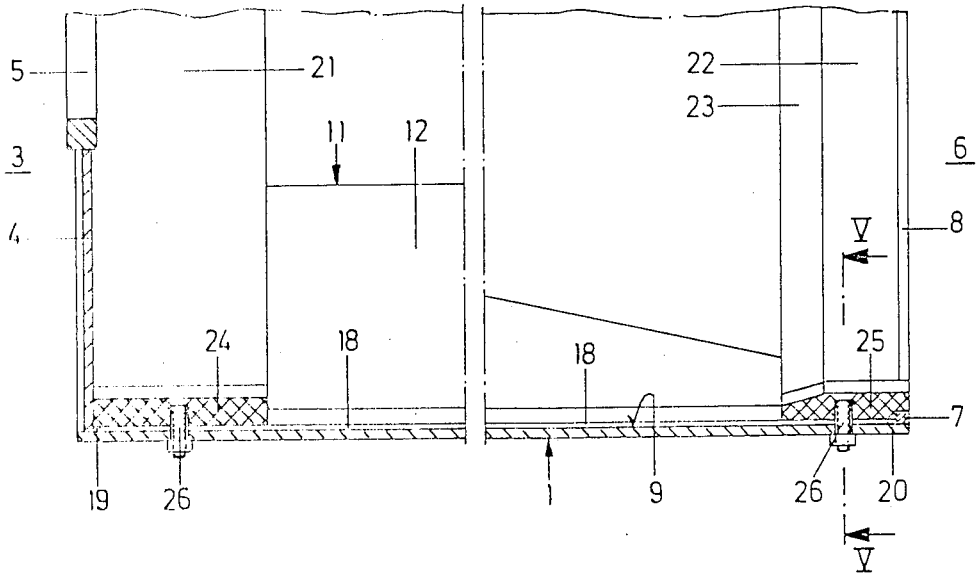
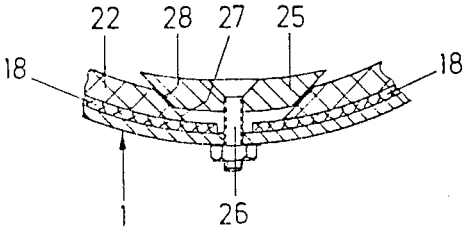
FIG. 5

LINER FOR A MIXER CONTAINER

FIELD OF THE INVENTION

The present invention relates to a liner for a cylindrical container of a mixer used for mixing materials that tend to stick; the cylindrical inner wall of the container is lined with at least one thin, interchangeable plate made of plastic.

BACKGROUND OF THE INVENTION

The problem of materials adhering to the inner wall of mixer containers arises particularly when chips are being glued. In principle, however, this problem can arise with all substances that tend to adhere to steel containers.

Liners of the above generic type have been known for over 12 years. They have been used especially in so-called drum mixers, that is, mixers used primarily for gluing chips, in which the cylindrical container is embodied as a drum and can be driven to rotate. Lifting devices, for instance in the form of so-called lifting strips, are disposed on the inside of the container, carrying the product that is to be mixed upward and then expelling the product, for example wood chips, freely into the interior of the container; gluing is effected during the free drop of the chips, by spraying or the like. This drum is lined such that plates corresponding to the tangential spacing between adjacent lifting strips are inserted and secured below the lifting strips. Such a provision is also known from European Pat. No. 0 077 838. In this known arrangement, certain portions of the inner wall of the container, in the vicinity of its ends, are not covered by the plates. The plates are also inadequately secured, depending on how the lifting device is embodied.

For mixers having upright cylindrical containers in which a rotatable mixing apparatus is thus disposed, it has heretofore been impossible to provide a liner having an interchangeable plastic plate, at an affordable cost. It is known from German Offenlegungsschrift No. 26 53 683 that a liner of anti-adhesive plastic can be provided in such a mixer for a cylindrical container that is divided along its central longitudinal axis; nevertheless, it was necessary to embody this liner in the form of half shells, with flanges, which is extraordinarily expensive.

SUMMARY OF THE INVENTION

It is accordingly the object of the present invention to devise a liner of the above generic type but which is largely unsecured and hence very simple to mount, and which is very effective.

Accordingly to the invention, this object is attained by elastically pressing the at least one plate radially outward against the inner wall of the container by means of a respective at least one tension ring made of smooth, flat plastic that hinders the adhesion of the materials being mixed. The essential feature is that the tension rings, which like the plate that acts as a liner are of simple plate-like plastic, hold the plate against the inner container wall at least partly by their elastic tensioning action. At the same time, the end portions of the container that are not covered by the plate, perhaps because of expansion due to heat, are covered by the tension rings, so that the cylindrical space is fully lined. To change the at least one plate, all that needs to be be done is to loosen the tension rings counter to their elastic pressing force and remove them. The at least one plate can then be pulled out. The tension rings are not joined in any way to the at least one plate.

By providing a releasable filler piece between the adjacent ends of a tension ring, the invention also enables compensation for temperature-caused changes in length of a given tension ring.

The invention also proposes advantageous dimensions for applications where only one tension ring is provided in the vicinity of one end of the container.

Further advantages and characteristics of the invention will become apparent from the ensuing detailed description of two exemplary embodiments, taken in conjunction with the drawings.

BRIEF DESCRIPTION OF THE DRAWINGS

FIG. 1 shows a cylindrical container of a drum mixer;

FIG. 2 is a section taken through the container along the line II—II of FIG. 1;

FIG. 3, on an enlarged scale, is a fragmentary section taken along the line III—III of FIG. 1 showing how a lifting strip and plates are secured;

FIG. 4 is a longitudinal section, on an enlarged scale, taken through the ends of the container of FIG. 1;

FIG. 5 is a section taken along the line V—V of FIG. 4;

DESCRIPTION OF THE PREFERRED EMBODIMENTS

Figure 6:
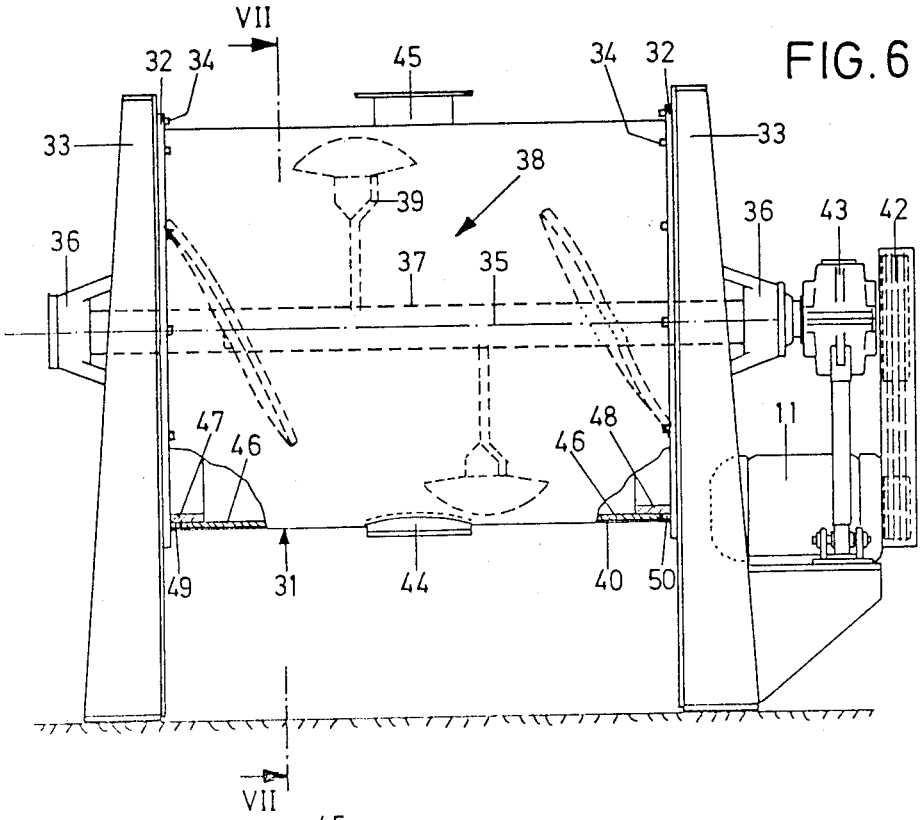
FIG. 6 shows a mixer with an upright container and a rotatable mixing apparatus, in a partially cutaway longitudinal side view.

FIG. 1 shows a container 1, embedded as a cylindrical drum, for an apparatus for continuous mixing of solids with liquids. The solids may be materials in fiber, chip, powder or granular form. The liquids may be any liquids that in any form whatever are to be distributed as uniformly as possible on the solid particles. Such apparatus is preferably used for gluing wood chips, in the form of so-called waferboard drums. Apparatus of this type is known for instance from German Offenlegungsschrift No. 27 44 522 (corresponding to U.S. Pat No. 4,188,130), German Offenlegungsschrift No. 16 53 181, or European Pat. No. 0 077 838. The cylindrical container 1, which has a relatively large diameter of 1.5 to 3 m and a length of from 4 to 7 m, is provided on its outer circumference with support rings 2 extending over the entire circumference; these rings serve to reinforce the container 1, which is made of sheet metal, and to guide it on support rollers of the apparatus, which is not shown. The drive of the drum is also effected via these support rings, by means of a friction wheel mechanism or the like. Drive mechanisms of this kind are also known from the above publications.

On the inlet side 3—on the left in FIG. 1—an annular disk 4 that protrudes radially inward is firmly joined to the container 1, and inside it an inlet opening 5 is provided for the introduction of solids and liquids and the like.

On the outlet ring 6 of the container 1—on the right in FIG. 1—the container is entirely open. Only a strip-like stop 7 that protrudes radially inward by a few millimeters and extends over the circumference of the container is provided on the outer rim of the container; naturally the stop 7 may also be interrupted, or in other words may comprise a plurality of separate pieces. Thus the container 1 is completely open on its outlet side 6, and so its entire front end serves as an outlet opening 8.

Angled lifting strips 11 are attached to the inner wall 9 of the container, extending substantially over its axial length and parallel to its axis 10, with a lifting arm 12 of the lifting strip pointing approximately radially into the container 1 while the other, securing arm 13 is disposed approximately parallel to the inner wall 9. Threaded bolts 14 are secured, for instance by welding, on the sides of the securing arms 13 that face the inner wall 9, the bolts being distributed over the length of these arms 13. The bolts 14 are inserted into and through corresponding bores 15 in the container 1, so that it is possible to secure the lifting strips 11 from outside the container 1 by means of self-locking nuts 16.

By means of the lifting strips 11, the product, such as chips or the like, located in the container 1 is carried upward in the usual manner when the container 1 rotates, and then the product drops back into the container from the lifting strips. The liquid is substantially applied during this drop. In order to reduce the lifting effect of the lifting strips in the vicinity of the outlet opening, their radial length is decreased in the vicinity of the outlet opening, as shown in FIGS. 1 and 4.

The inner wall 9 of the container 1 is provided with a liner, which substantially comprises rectangular plates 18. These plates are each located beneath the securing arms 13 of the lifting strips 11 extending to near the threaded bolts 14, as shown particularly clearly in FIG. 3. Thus these plates 18 are put into place before the lifting strips 11 are installed and then are tightened along with them when the lifting strips are secured. Two adjacent plates 18 are accordingly spaced apart by a distance somewhat larger than the diameter of the threaded bolts 14. This free space is covered completely by the respective securing arm 13 of the corresponding lifting strip 11.

The ends of the lifting strips 11 are spaced 50 to 150 mm from the annular disk 4 located on the inlet side 3, on the one hand, and from the outlet opening 8, on the other. In these areas, the spaces between the plates 18 would not be covered, and furthermore the plates are not secured in this region. Also, for reasons having to do with manufacturing requirements and also because of heat expansion, the plates 18 cannot extend exactly over the length of the container; a certain portion 19 or 20 of the inner wall 9 of the container 1 on the inlet side 3 and outlet side 6, respectively, is necessarily left uncovered by the plates.

A respective tension ring 21 and 22 is therefore provided on the inlet side 3 and outlet side 6. The tension ring 21 located on the inlet side 3 is fitted exactly into the space between the annular disk 4, which forms one end of the container, and the associated end of the lifting strips 11. The axial length of this tension ring 21 is therefore approximately 50 to 150 mm. It has a rectangular cross section.

The tension ring 22 on the outlet side 6 presses against the stop 7 on one side and against the associated end of the lifting strips 11 on the other. Its axial length is accordingly approximately 50 to 150 mm. On its side facing the container, the tension ring 22 has an oblique face 23 that drops toward the container, so as to facilitate the flow of material out of the container 1. Accordingly, the tension rings 21, 22 completely cover not only the free spaces between adjacent plates 18 but also the portions 19, 20.

The tension rings 21, 22 and the plates 18 are made of plastic, to which the liquids used, in particular glue, do not adhere. Especially when glue is used, polyethylenes of ultrahigh molecular weight have proved to be particularly suitable. Naturally polytetrafluorethylene is also especially suitable, but because of its cost it can be used only in special cases.

The plates 18 have no other function than acting as a liner and so they can be made relatively thin. Thicknesses of from 3 to a maximum of 5 mm have proved to be advantageous. The tension rings 21, 22, contrarily, substantially have a structural function; by means of them, the plates 18 are at least partly secured. The tension rings 22, 23 are also made of plate-like material, which after being bent into a circular-cylindrical form exerts high tensioning forces, directed radially outward, upon the plates. The tension rings 21, 22 must therefore be considerably thicker than the plates 18. Thicknesses of from 10 to a maximum of 25 mm have proved to be both adequate and suitable.

In order that an open space will not be left between the two butt ends of a tension ring 21 or 22, this gap can be filled with a filler piece 24 or 25, as shown in FIG. 4. The respective filler piece 24 or 25 is screwed firmly to the container wall using a screw 26.

In order to be able to compensate for varying gap widths between the ends of a given tension ring 21 or 22, the tension rings can be provided with oblique faces 27 on their ends that drop toward the inner wall 9, with correspondingly inclined contacting surfaces 28 provided on an associated filler piece. This makes it possible to compensate for a play of a few millimeters in the length of the tension ring 21 or 22. This is illustrated in FIG. 5 for only the filler piece 25 associated with the tension ring 22. Naturally, the filler pieces 24, 25 are made of the same material as the tension rings 21, 22 and the plates 18.

The lifting strips 11 are provided with a coating 29 which likewise prevents the adhesion of the liquids that are used. These coatings 29 can be applied in the course of a so-called powder coating by thermal sintering means. Polyamides in powdered form are also suitable to this end.

Figure 7:
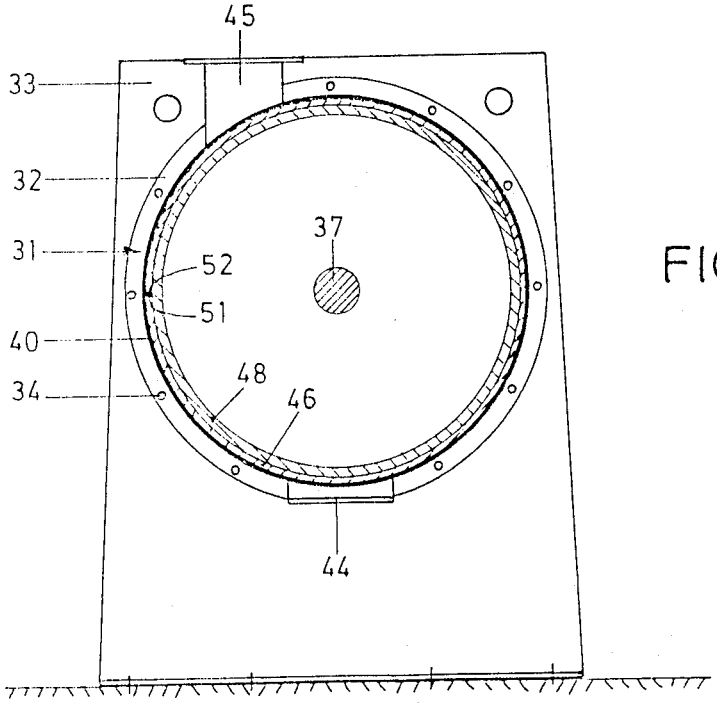
FIG. 7 is a cross section taken through the mixer along the line VII—VII of FIG. 6, not showing the mixing apparatus.

The liner of the container can also be used in mixers having stationary containers with a mixing apparatus disposed therein. An embodiment of this kind is shown in FIGS. 6 and 7. Mixers of this kind have a stationary cylindrical container 31, which is releasably attached with flanges 32 on its ends to side walls 33, which simultaneously serve as stands, by means of screws 34. A bearing block 36, in which a shaft 37 of a mixing apparatus 38 is supported, is disposed in each of the side walls 33, in alignment with the axis 35 of the cylindrical container 31. Mixing tools 39 protrude radially from the shaft 37 as far as the vicinity of the inner wall 40 of the container 31. A driving motor 41, which drives the mixing apparatus 38 via a V-belt drive 42 and a gear 43, is attached to one side wall 33.

An outlet opening 44 is disposed in the lower portion of the container 31, and a suitable lid or the like can be disposed before this outlet opening. An inlet opening 45 for the product that is to be mixed is provided in the upper portion.

The cylindrical inner wall 40 of the container 31 is in this case lined with a single, cylindrically curved plate 46, which before the side walls 33 are installed is bent into shape and inserted into the container 31. There, because of its elastic properties, it expands and presses against the inner wall 40 of the container 31.

Tension rings 47, 48 are again provided on the two ends of the container 31 facing the side walls 33. Because of their already-described elastic properties, the tension rings 47, 48 hold the plate 46 that serves as a liner and simultaneously they also cover the portions 49, 50 that remain in the outer areas of the container and that are not covered by the plate 46. The abutting edges 51, 52 of the plate 46 that is bent into a cylinder rest tightly against one another. Since as a rule it must be expected that the plate 46 is subject to considerable expansion due to heat, it may be useful here to embody the abutting edges 51, 52 in the manner shown for the tension ring 22 in FIG. 5, and to provide a filling strip, corresponding in cross section approximately to the filler piece 25 of FIG. 5, and which again should be secured by means of a screw. A filler strip of this type would, however, have to have its inner surface flush with the inside of the plate 46, or in other words must not protrude farther inward into the container 31, because the mixing tools 39 are extended to very close to the inner wall. Since the embodiment corresponds to FIG. 5 in this respect, it need not be shown separately here.

Filler pieces can also be provided for the tension rings 47 and 48; again, they are not shown separately because they can be embodied identically to the filler pieces shown in FIG. 4. The plate 46 is recessed appropriately in the vicinity of the inlet opening 45 and the outlet opening 44 of the container 31.

What has been said for the first exemplary embodiment applies equally to the plate 46 and the tension rings 47, 48 in terms of the plastic used and the dimensions selected.

In particular when an upright container is used, as shown and described for the second exemplary embodiment, that is, one which is provided with a sufficiently large opening in the vicinity of the side walls 33, the plate 46 may be dimensioned in accordance with the container diameter such that it remains in its position by its own inherent tension. In that case, the plate 46 itself simultaneously takes on the function of the tension rings.

What is claimed is:

1. A mixer for continuous mixing of solids with liquids, tending to adhere, comprising:

a hollow cylindrical container with an inner wall, having a substantially horizontal axis and an inlet end and an outlet end, said container being driven during operation so as to rotate about said horizontal axis;

said container having an inlet opening at said inlet end and an outlet opening at said outlet end;

said inner wall being provided with a plurality of lifting strips extending substantially along the axial length and parallel to the axis of the container, said lifting strips each having a lifting arm extending approximately radially into the container and a securing arm being disposed approximately parallel to the inner wall, and said lifting strips each extending from an upstream end near said inlet end to a downstream end near said outlet end;

each said securing arm being secured to the wall of the container by a plurality of bolts distributed along the length of each securing arm;

the inner wall of the container being provided with substantially rectangular plates of a liner, said plates having side edges located beneath the securing arms of the lifting strips extending near to the bolts and being secured to the inner wall of the container by the securing arms of the lifting strips with the plates forming a free space betwen adjacent edges of adjacent plates, with said bolts extending through the free space and the free space being covered by the securing arms;

an upstream plate-like tension ring extending along and covering said inner wall from said inlet end to said upstream end of said lifting strips, and a downstream plate-like tension ring extending along and covering said inner wall from said downstream end of said lifting strips to said outlet end, said plate-like tension rings covering the free spaces between adjacent plates and parts of the inner wall not covered by said rectangular plates, said tension rings pressing said rectangular plates against the inner wall of the container adjacent the ends of the container; and said rectangular plates and said plate-like tension rings consisting of plastic material, preventing adhesion of solids with liquids.

2. A liner for a cylindrical container of a mixer for mixing of solids with liquids which tend to adhere, the cylindrical container having an inner wall and a substantially horizontal axis with an inlet end and an outlet end, said liner comprising:

a plurality of substantially rectangular liner plates for lining the interior wall of the container, said rectangular liner plates each extending lengthwise from near the inlet end of the container to near the outlet end, said liner plates having side edges so that when said plates line the inner wall of the container there are elongated gaps extending between the side edges of adjacent plates;

said rectangular liner plates being retained in place along the inner wall of the container by a plurality of lifting strips of the container which extend along the gaps between adjacent rectangular liner plates along the axial length and parallel to the axis of the container from an upstream point to a downstream point, the lifting strips each having a securing arm disposed approximately parallel to the inner wall of the container and held to the container by a plurality of bolts extending along the length of each securing arm, the bolts extending through the gap between adjacent side edges of the rectangular liner plates;

an upstream plate-like tension ring extending along and covering the inner wall of the container from the inlet end to the upstream point of the lifting strips, and a downstream plate-like tension ring extending along and covering the inner wall from the downstream point of the lifting strips to the outlet end, said plate-like tension rings covering the free spaces between adjacent plates and parts of the inner wall not covered by said rectangular plates, said tension rings pressing said plates against the inner wall of the container adjacent the ends of the container; and said rectangular plates and said plate-like tension rings consisting of plastic material, preventing adhesion of solids with liquids.

3. A liner in accordance with claim 2 wherein said plate-like tension rings have a thickness of approximately 10–25 mm.

4. A liner according to claim 3 wherein said tension rings have an axially length of 50–150 mm.

5. A liner according to claim 2 wherein said tension rings constitute curved rectangular plates each having two butt facing ends, said butt facing ends having inclined faces to provide a generally V-shaped axially extending groove between said butt ends when said tension rings are installed for use in said container, said V-shaped grooves being filled with a complementary shaped filler piece adapted to be bolted to the container.

* * * * *